United States Patent [19]

Mitchell et al.

[11] 4,426,110

[45] Jan. 17, 1984

[54] CONTINUOUS ROTATION HYDRAULIC GRAPPLE

[75] Inventors: Johnny D. Mitchell, Gresham; Hugh D. Armstrong, Sandy, both of Oreg.

[73] Assignee: Mar Hook & Equipment, Inc., Sandy, Oreg.

[21] Appl. No.: 303,112

[22] Filed: Sep. 17, 1981

[51] Int. Cl.[3] ..... B66C 13/14

[52] U.S. Cl. ..... 294/88; 294/106

[58] Field of Search ..... 294/88, 70, 106, 118; 414/705, 739, 624, 625, 626, 694, 726; 37/183, 184, 185, 186, 187, 188

[56] References Cited

U.S. PATENT DOCUMENTS 3,795,421 3/1974 Vohl et al. ..... 294/88

3,877,743 4/1975 Johnson ..... 294/88

*Primary Examiner*—James B. Marbert

*Attorney, Agent, or Firm*—Harvey B. Jacobson

[57] ABSTRACT

An upper head connector for support from a crane boom is provided and has a depending head journaled therefrom for reversible continuous rotation relative thereto about an upstanding axis. A rotator (motor) is supported from the head connector and includes an upper portion supported from the head connector and a lower rotatable portion supported from the upper portion for reversible continuous rotation relative thereto about an axis at least substantially coinciding with the first mentioned axis. Connecting structure is provided establishing a driving connection between the lower portion of the rotator and a lower level portion of the head for rotary drive of the latter by the rotator independent of support of any appreciable downward loading of the weight of the head or a load supported therefrom on the rotator lower portion. Further, grapple jaw structure is pivotally supported from the head for selective angular displacement relative thereto and is actuated by fluid cylinders interconnected between the grapple jaw structure and the head. The upper and lower rotator portions include structure defining fluid pressure passages extending therebetween and for continuously communicating a fluid pressure source with jaw structure actuating hydraulic cylinders.

5 Claims, 8 Drawing Figures

Fig. 5
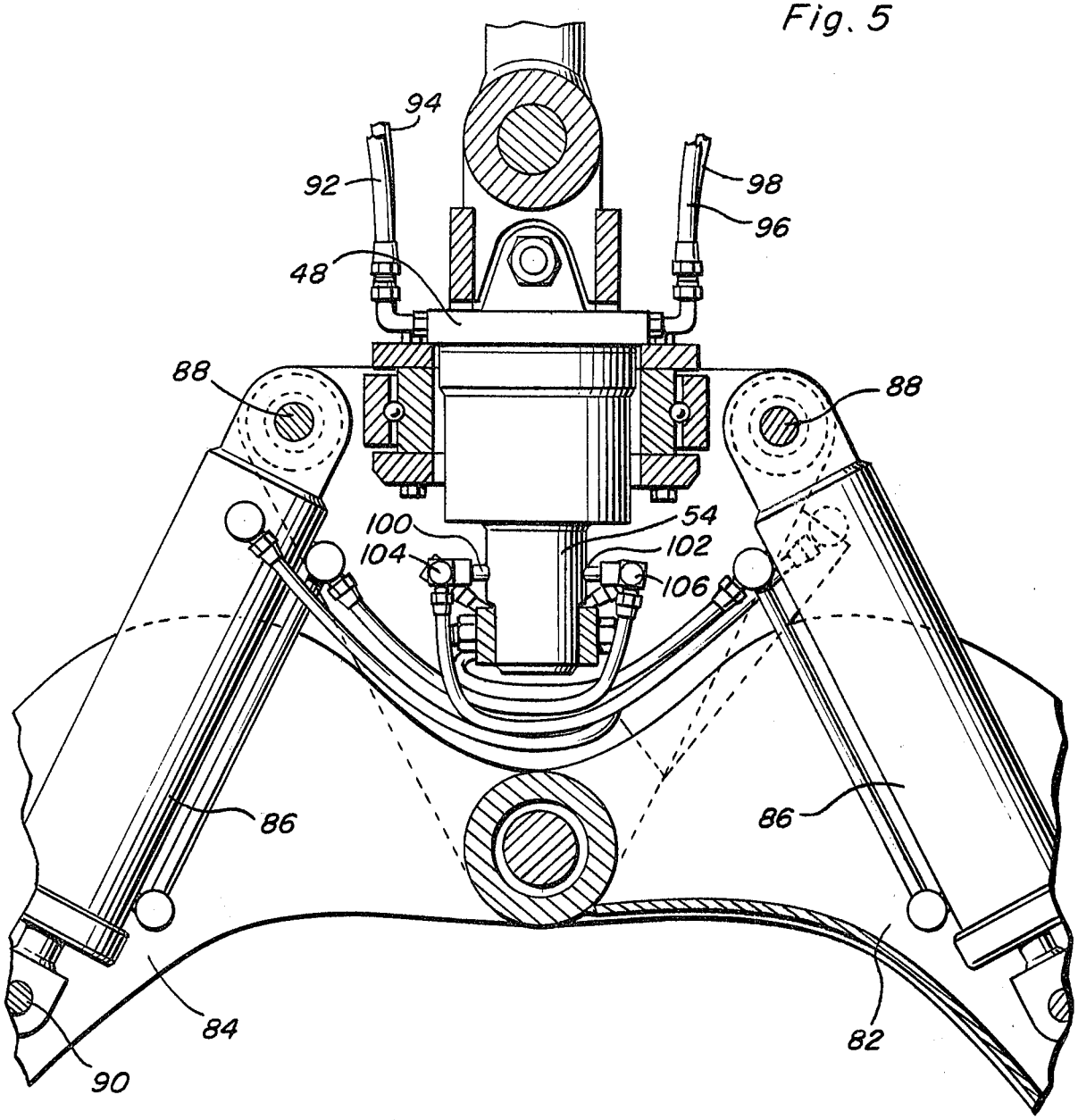
Fig. 6
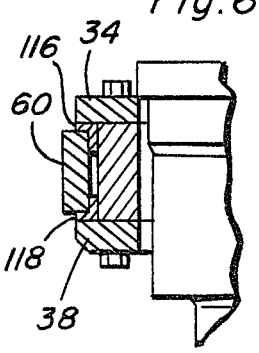
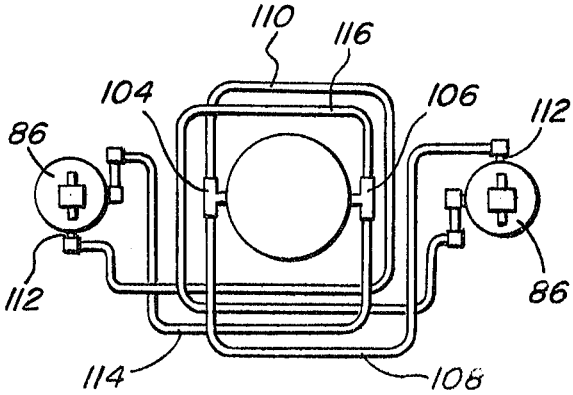
Fig. 7

CONTINUOUS ROTATION HYDRAULIC GRAPPLE

BACKGROUND OF THE INVENTION

Various forms of grapples of the continuous rotation type are provided and are considered most desirable when used as log grapples. However, such continuous rotation log grapples heretofore known utilize rotator (hydraulic motor) devices which have first stationary components thereof supported from corresponding crane booms and second rotatable components thereof from which the corresponding grapple jaw structures are supported with at least a major portion of the weight of the grapple jaw structures and the loads supported therefrom being transmitted to the associated crane boom through the rotator. This type of continuous rotation grapple assembly therefore requires that the rotator be extremely heavily constructed in order to withstand the axial loading thereon and, accordingly, the expense of hydraulic log grapples of the continuously rotatable type heretofore has been unnecessarily high and the need to provide a heavily constructed rotator for supporting the load of the grapple jaw structure and the load supported therefrom effectively reduces the maximum useful load which may be supported from the associated crane boom. Accordingly, a need exists for a continuous rotation log grapple assembly of an improved design whereby the rotator thereof is free of any loading thereof by the attendant grapple assembly and the load being supported by the grapple assembly.

Examples of previously known forms of grapple assemblies including some which are of the continuous rotation type are disclosed in U.S. Pat. Nos. 3,210,115, 3,914,886, 4,005,894, 4,005,895, 4,047,313, 4,099,761, 4,009,762, 4,211,252 and 4,239,273.

BRIEF DESCRIPTION OF THE INVENTION

The hydraulic grapple assembly of the instant invention is of the continuously rotatable type and includes an upper head connector for support from an associated crane boom, a depending head, journal structure supporting the head from the head connector for reversible continuous rotation relative thereto about an upstanding axis and a rotator (motor) including an upper portion mounted from the head and a lower rotatable portion supported from the rotator upper portion for reversible continuous rotation relative thereto about an axis at least substantially coinciding with the first mentioned axis. Connecting structure is provided establishing a driving connection between the lower portion of the rotator and a lower level portion of the head for rotary drive of the latter by the rotator independent of support of any appreciable downward loading of the weight of the head or the load supported therefrom on the rotator. The relatively swingable jaws of the grapple assembly are pivotally supported from the head and operable by fluid cylinders connected between the head and the jaws.

Inasmuch as the jaw operating hydraulic cylinders must be capable of continuous rotation with the head relative to the head connector from which the head is journaled for continuous rotation about a vertical axis, the rotator lower portion includes fluid pressure outlet and inlet ports which may be communicated with the jaw actuating cylinders through suitable pressure lines, the upper portion of the rotator includes fluid pressure inlet and outlet ports to which supply and return lines from a suitable source of hydraulic fluid under pressure may be connected and the upper and lower portions of the rotator include coacting structure which functions to maintain the inlet and outlet ports of the upper portion of the rotator in continuous communication with the outlet and return ports of the lower rotatable portion of the rotator.

The main object of this invention is to provide a continuous rotation grapple including a rotator therefor which is not required to withstand axial loads consisting of the weight of the associated grapple assembly head and jaws and any load supported therefrom.

Another object of this invention is to provide a continuous rotation hydraulic log grapple constructed in accordance with the preceding object and including a rotator therefor having an upper portion for support from a head connector and a rotatable portion for driving connection (independent of axial loading) with the associated grapple head and with the upper and lower portions of the rotator including inlet and outlet ports in continuous communication with outlet and return ports formed in the lower portion of the rotator.

A final object of this invention to be specifically enumerated herein is to provide a grapple assembly in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 5 is an enlarged fragmentary vertical sectional view taken substantially upon the plane indicated by the section line 5—5 of FIG. 3;

FIG. 6 is a fragmentary vertical sectional view similar to the upper left hand portion of FIG. 5 and illustrating a modified bearing structure for rotatable support of the head of the grapple assembly from the associated head connector;

FIG. 7 is a schematic view illustrating the hydraulic circuitry of the lower portion of the grapple rotator and the hydraulic cylinders of the grapple assembly.

DETAILED DESCRIPTION OF THE INVENTION

Figure 1:
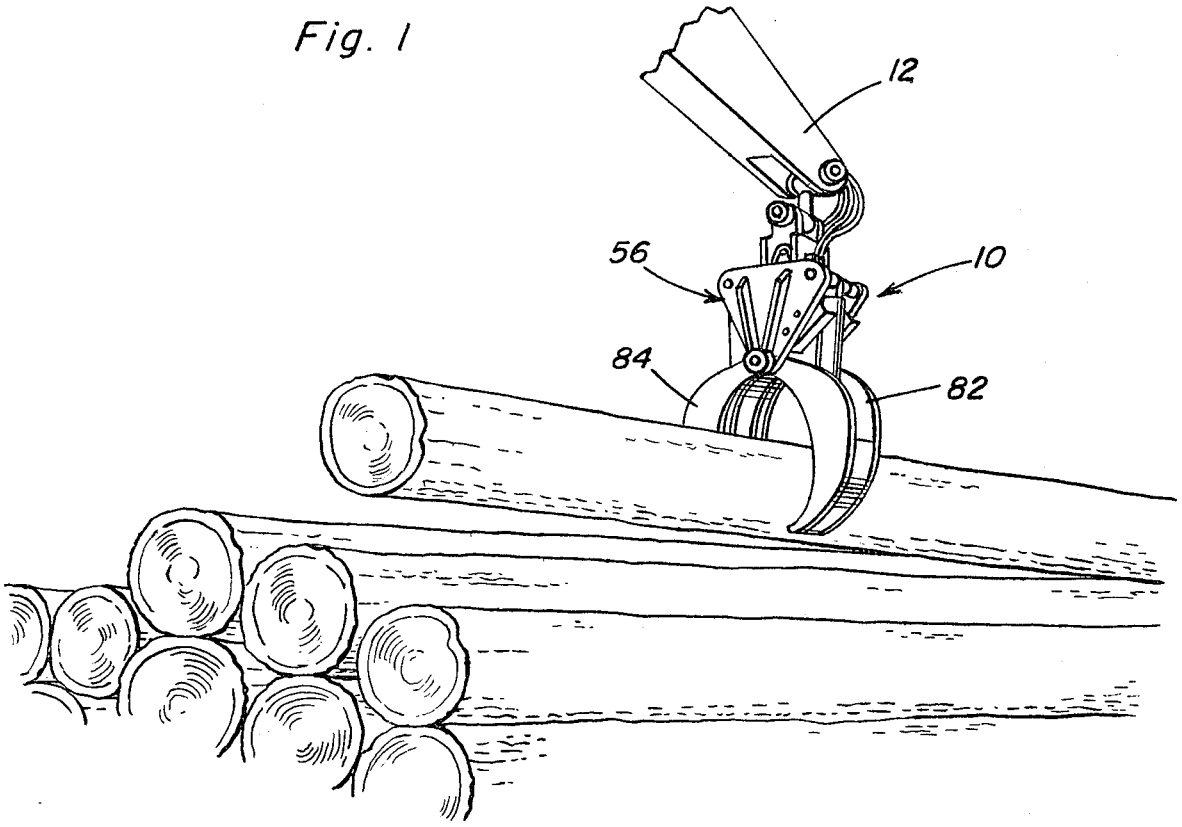
FIG. 1 is a perspective view of the continuous rotation hydraulic grapple of the instant invention in use supporting a large log therefrom.

Referring now more specifically to the drawings the numeral 10 generally designates a grapple assembly constructed in accordance with the present invention. The grapple assembly 10 is supported from the free end of a crane boom 12 from which a two pin pivot link 14 is pivotally supported for oscillation about a horizontal axis by a first pivot pin 16 disposed substantially normal to the vertical plane in which the boom 12 may be swung. The pivot link 14 includes a lower horizontal journal portion 18 disposed at right angles to the pivot pin 16 and which receives a second pivot pin 20 therethrough. The opposite ends of the pivot pin 20 are received through a pair of horizontally spaced mounting flange portions 22 and 24 of a head connector referred to in general by the reference numeral 26. The mounting flange portions 24 include aligned bores 28 through which the pivot pin 20 is secured, there being provided thrust washers 30 on opposite ends of the pivot pin 20 disposed between the opposing sides of the mounting flange portions 22 and the adjacent ends of the journal portion 18.

The head connector 26 comprises a part of the grapple assembly 10 and includes a pair of opposite side plates 32 between which the mounting flange portions 22 and 24 are secured. The lower ends of the side plates 32 are interconnected by an upper plate 34 having a central large diameter opening 36 formed therein. A lower plate 38 of generally annular configuration is supported in spaced relation beneath the upper plate 34 through the utilization of a cylindrical spacing member 40 disposed between the plates 34 and 38, a plurality of threaded bolts 42 being secured through the upper and lower plates 34 and 38 and circumferentially spaced portions of the spacing member 40.

In a first form of the invention illustrated in FIGS. 1 through 5, the head connector 26 includes a pair of spaced mounting plate portions 44 extending and secured between the side plates 32 and a rotator (hydraulic motor) referred to in general by the reference numeral 46 includes an upper portion 48 having a mounting journal portion 50 disposed between and pivotally supported from the mounting plate portions 44 through the utilization of a pivot bolt or fastener 52. The rotator 46 includes a continuously rotatable lower shaft portion 54 which is rotatable relative to the upper portion 48 about a vertical axis extending longitudinally of the rotator 46.

A head referred to in general by the reference numeral 56 is provided and includes a pair of opposite side plates 58 between whose upper ends a cylindrical bearing member 60 is secured, the side plates 58 being vertically disposed and the bearing member 60 being disposed with its center axis vertically disposed. The bearing member 60 is disposed outwardly of and coaxial with the spacing member 40 between the upper and lower plates 34 and 38 and the opposing outer and inner surfaces of the spacing member 40 and the bearing member 60 include partial cylindrical inwardly and outwardly opening bearing race defining grooves 64 and 66 formed therein, a plurality of spherical bearing member 68 having remote side portions rollingly received in corresponding opposing portions of the grooves 64 and 66. Accordingly, the side plates 58 of the head 56 are journaled from the head connector upper and lower plates 34 and 38 for rotation about a vertical axis and the vertical axis of rotation of the head 56 relative to the head connector 26 at least substantially coincides with the axis of rotation of the lower portion 54 of the rotator 46 relative to the upper portion 48 of the rotator 46.

The lower end of the lower shank portion 54 includes a downwardly opening diametric slot 70 formed therein and a pair of torque transfer bars 72 extend and are secured between the side plates 58 and a bolt type fastener 74 is secured through the torque transfer bars 72 and the slot 70 whereby rotary torque may be applied to the head 56 by the lower shank portion 54 in order to rotate the head 56 relative to the head connector 26.

The side plates 58 are provided with a plurality of outstanding reinforcing plates 76 secure to the outer sides of the plates 58 and the lower ends of the plates 58 define journal portions 78 between which a pivot pin 80 is removably secured, the pivot pin 80 having the upper ends of a pair of vertically elongated grapple jaws 82 and 84 oscillatably mounted thereon.

As may be seen from FIG. 5 of the drawings, a pair of double acting hydraulic cylinders 86 are pivotally connected between pivot fasteners 88 secured between upper portions of the side plates 58 and anchor pins 90 secured between opposite side plate portions of the jaws 82 and 84.

The rotator 46 may comprise a model M-726 rotator, by Tico and that model rotator includes a pair of supply and return lines 92 and 94 which open into the interior of the upper portion 48 of the rotator and may be selectively communicated with a suitable supply of fluid under pressure and a reservoir for causing the lower portion to be selectively continuously rotated in opposite directions. In addition, a second pair of hydraulic lines 96 and 98 open into the upper portion 48 and the upper portion 48 and lower portion 54 include internal passages which continuously communicate the lines 96 and 98 with pipes 100 and 102 having manifold fittings 104 and 106 coupled thereto. The fitting 104 has lines 108 and 110 coupled thereto which open into the upper ends of the hydraulic cylinders 86 as at 112 and the fitting 106 has lines 114 and 116 connected thereto which open into the lower ends of the cylinders 86. Accordingly, independent of continuous rotation of the head 56 relative to the head connector 26 or the direction of rotation of the head 56 relative to the head connector 26, the lines 96 and 98 may be selectively used as supply and return lines to selectively extend and retract the cylinders 86. Of course, the lines 92, 94, 96 and 98 are communicated with a suitable source (not shown) of hydraulic fluid under pressure and a hydraulic reservoir (not shown) through any suitable control system (not shown).

However, it will be noted that the bearing members 68 support the entire weight of the head 56 from the head connector 26 during rotation thereof independent of any axial loading of the weight of the head 56 or the load supported therefrom on the rotator 46.

With attention now invited more specifically to FIG. 6, there may be seen a modified form of bearing assembly between the head 56 and the head connector 26. That bearing assembly utilizes the plates 34 and 38 and the bearing ring or member 60, but rather than using the bearing members 68, bearing sleeves 116 and 118 of generally L-shaped radial cross-section are used between the plates 34 and 38 and the ring 60.

Figure 8:
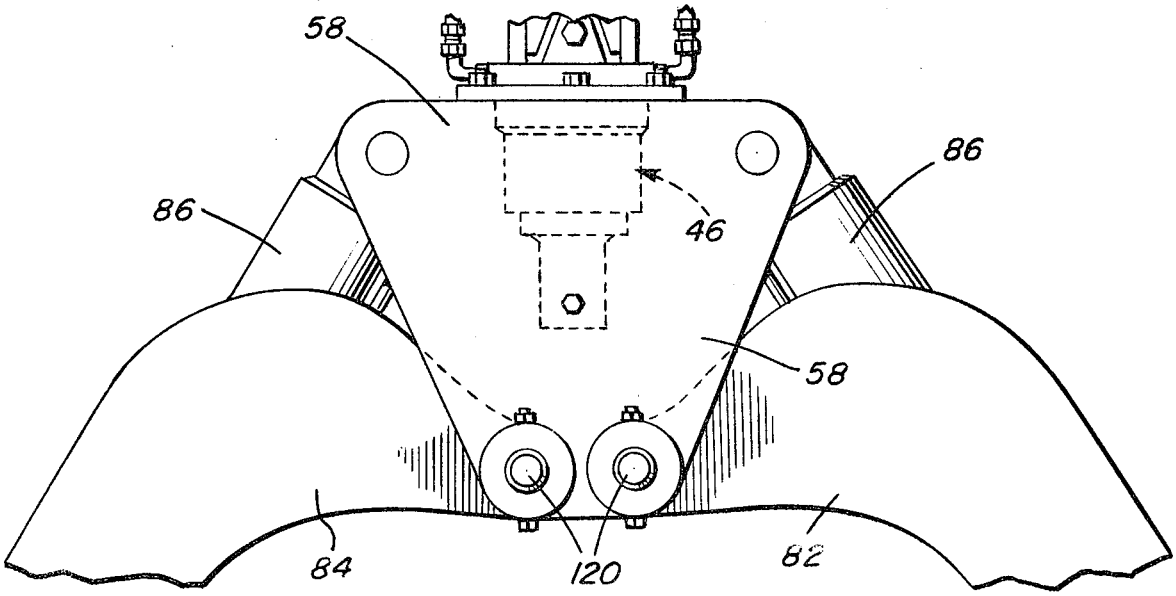
FIG. 8 is a fragmentary front elevational view similar to the central portion of FIG. 2, but illustrating a modified pivot structure for the jaws of the grapple assembly.
Figure 2:
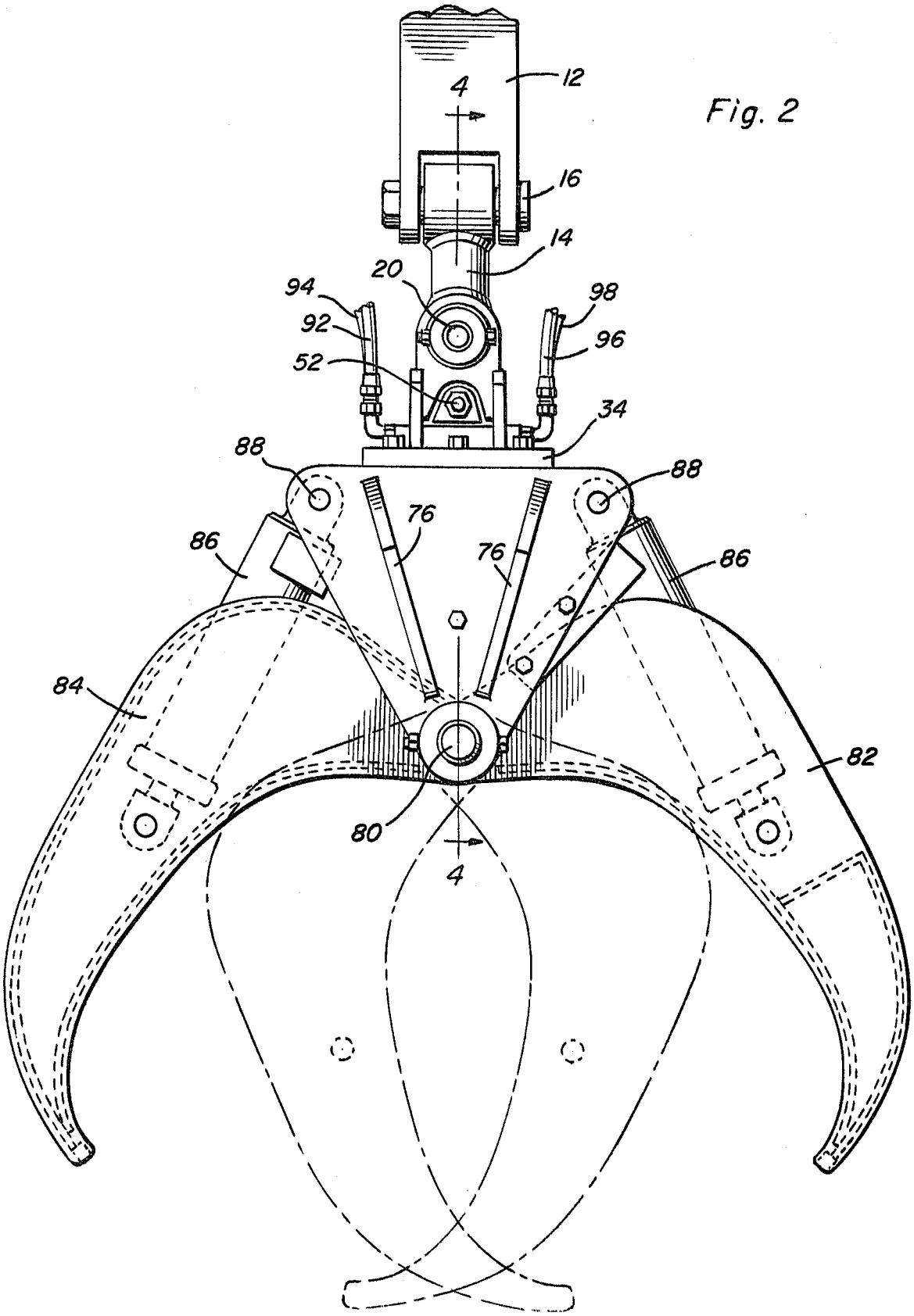
FIG. 2 is an enlarged front elevational view of the grapple assembly with the jaws thereof being illustrated in open positions in solid lines and in closed positions in phantom lines.
Figure 3:
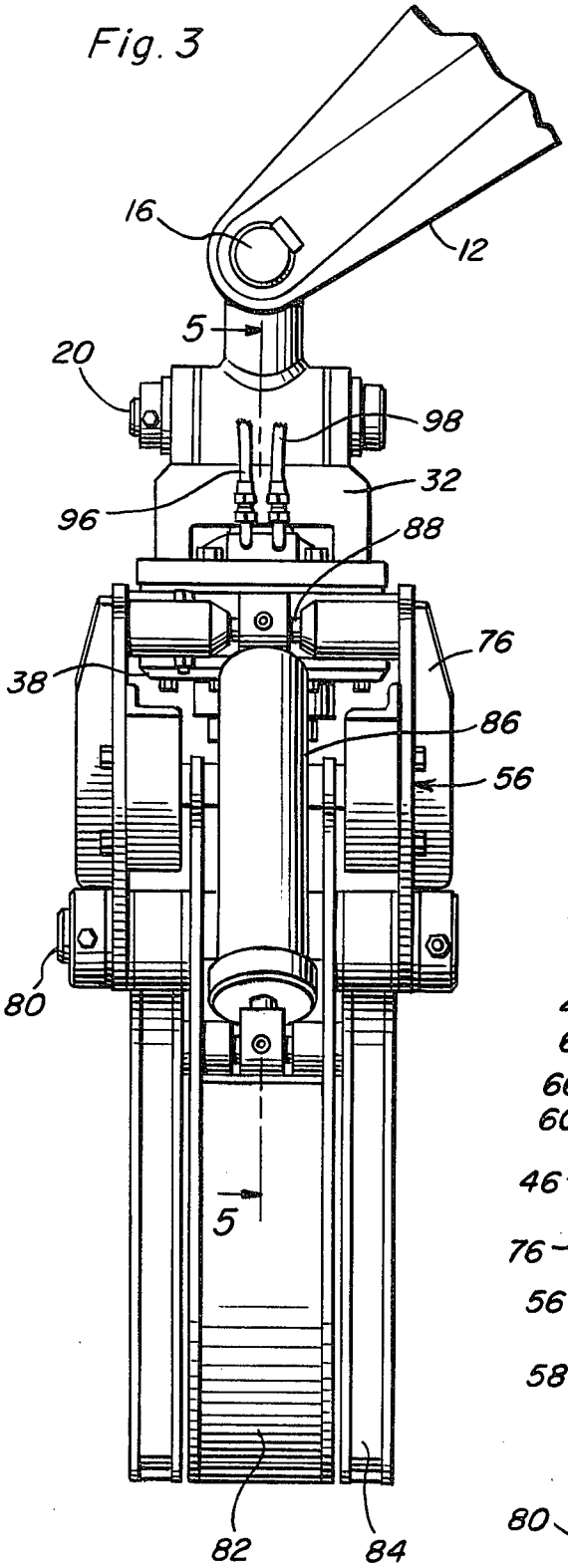
FIG. 3 is a side elevational view of the grapple assembly illustrated in FIG. 2.
Figure 4:
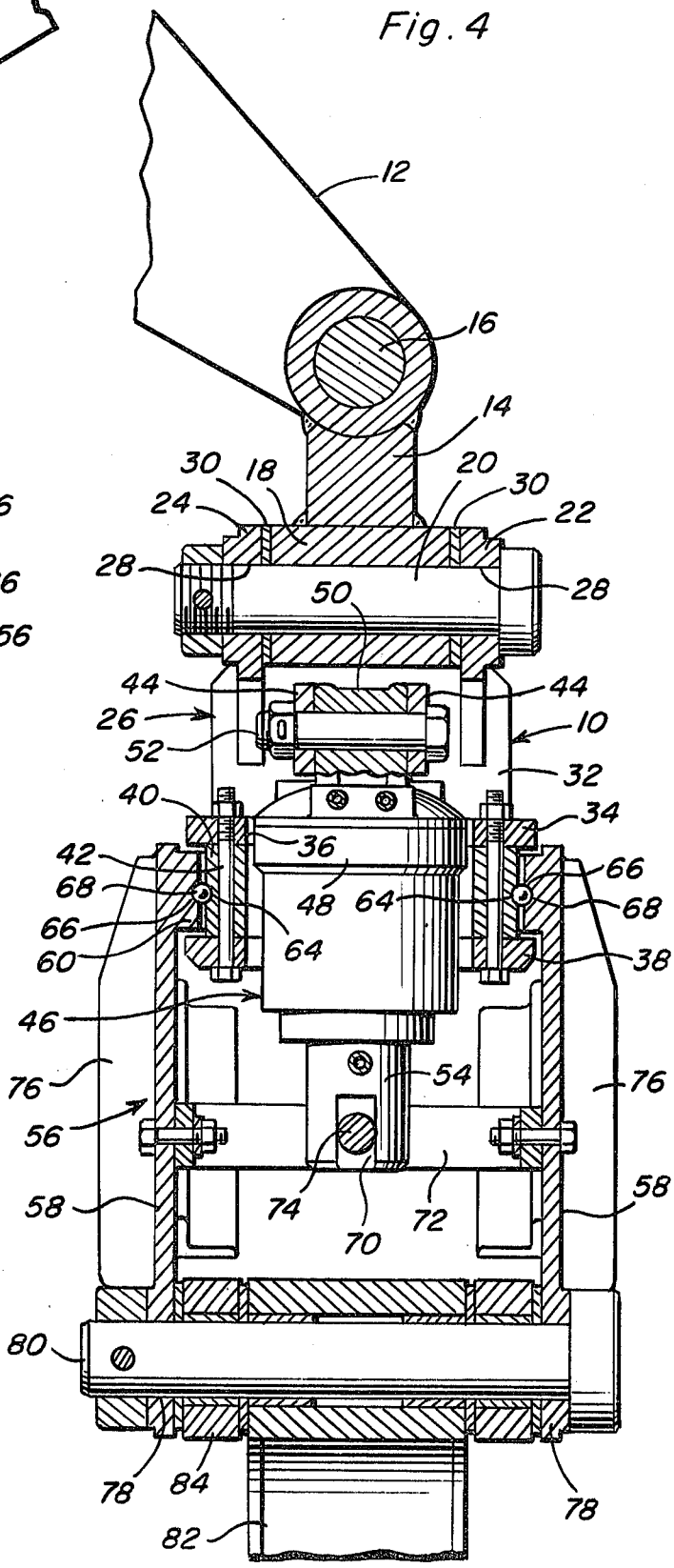
FIG. 4 is an enlarged fragmentary vertical sectional view taken substantially upon the plane indicated by the section line 4—4 of FIG. 2.

Also, with attention invited more specifically to FIG. 8 of the drawings, it may be seen that the grapple jaws 82 and 84 may be pivotally supported from the lower ends of the side plates 58 through the utilization of a pair of pivot fasteners 120 in lieu of the single pivot fastener 80 illustrated in FIGS. 2, 4 and 5.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A grapple assembly including an upper head connector for support from a crane boom, a depending head, journal means supporting said head from said head connector for reversible continuous rotation relative thereto about an upstanding axis, a rotator (motor) including an upper portion supported from said head connector and a lower rotatable portion supported from said upper portion for reversible continuous rotation relative thereto about an axis at least substantially coinciding with the first mentioned axis, connector means establishing a driving connection between said lower portion and a lower level portion of said head for rotary drive of the latter by said rotator independent of support of any appreciable downward loading of the weight of said head or a load supported therefrom on said rotator lower portion, grapple jaws means pivotally supported from said head for selective angular displacement relative thereto, reversible hydraulic motor means operatively connected between said head and said grapple jaw means for oscillating the latter relative to said head, said upper and lower portions of said rotator including means defining relatively rotatable fluid coupling means including at least two ports on said upper rotator portion in constant fluid communication with a pair of fluid ports on said lower rotator portion throughout rotation of the lower rotator portion relative to the upper rotator portion, and means defining fluid pressure passages communicating said lower rotator fluid ports with said reversible motor means.

2. The grapple assembly of claim 1 wherein said head connector includes a pair of interconnected horizontally and laterally spaced upstanding side plates between whose lower portions said grapple jaw means is pivotally supported, a horizontal bearing ring mounted between the upper portions of said plates, said head connector including a lower portion having a pair of upper and lower coaxial vertically spaced guide rings supported relative to each other by a spacing guide ring rigid therewith and disposed therebetween, at least one of said guide rings and said bearing ring including bearing means defining said journal means.

3. The grapple assembly of claim 2 wherein said journal means includes inner and outer race means on said spacing guide ring and bearing ring, respectively, and bearing means interposed between said race means.

4. The grapple assembly of claim 2 wherein said journal means includes combined axial and radial thrust bearing rings in juxtaposition relative to the upper and lower surfaces of said lower and upper guide rings, respectively, said bearing ring being greater in outside diameter than the inside diameter of said upper and lower guide rings and interposed between the latter and said bearing rings.

5. The grapple assembly of claim 1 wherein said grapple jaw means comprises a pair of upstanding and opposing horizontally spaced apart jaws pivotally anchored adjacent their upper ends between the lower portion of said plates, said hydraulic motor means including a pair of double acting hydraulic cylinders each pivotally connected between said head and a corresponding jaw.

* * * * *